PROCESSING OF FIBROUS MATERIALS TO REDUCE SAME TO A GENERALLY HOMOGENEOUS MASS OF FIBERS

This invention relates to a method of, and apparatus for processing fibrous material to reduce it to a generally homogeneous mass of fibres, such as a mass of textile fibres suitable for use in spinning and lap forming. The invention can also be applied to the processing of non textile fibres such as carbon fibres and metal fibres.

Proposals have been made for using conventional carding machines and garnetts for producing fibres for use in spinning and lap forming, in textile processing, but such proposals have resulted generally in machines which have limited production rates, and which tend to be large and expensive.

The present invention seeks to provide a method and apparatus which will be more suitable than the previous proposals.

According to this invention there is provided a method of processing fibrous materials to produce a homogeneous mass of fibres, wherein the fibrous material is treated by at least one group of clothed cylinders comprising a first treatment cylinder, a second treatment cylinder lying generally tangentially to the first cylinders, and a working cylinder lying generally tangentially to each of the first cylinder and the second cylinder, the cylinders being rotated so that the first and second cylinders rotate in opposte directions with the clothing of the second cylinder travelling faster than the clothing of the first cylinder, and the working cylinder rotates in the same direction as the first cylinder with the clothing thereof travelling slower than the clothing of each of the first and second cylinders, and wherein the fibrous material travels on the clothing of the first cylinder to where the second cylinder takes the fibrous material with a drafting and tearing effect, and the working cylinder takes knotted portions, slubs and impurities from the second cylinder and carries same round and returns same to the first cylinder clothing for reprocessing. Preferably, there are three groups of clothed cylinders, arranged in series, and the second clothed cylinder of the first group is also the first cylinder of the second group, and the second clothed cylinder of the second group is also first cylinder of the third group. The groups of cylinders are enclosed in a closely fitting casing serving to hold the fibrous materials to the cylinders, said casing having an inlet whereby fibrous material can be fed to the first cylinder of the first group, and an outlet whereby fibres can be discharged from the second cylinder of the third group.

The cylinders are preferably rotated at such speeds that at said outlet the fibres are at least mainly discharged by virtue of the velocity of the clothing and there is preferably a means creating an induced draught stripping fibres from the second roller from the third group.

The invention also provides a machine for processing fibrous material to produce a homogeneous mass of fibres, comprising at least one group of clothed cylinders comprising a first treatment cylinder, a second treatment cylinder lying generally tangentially to the first cylinder, and a working cylinder lying generally tangentially to each of the first cylinder and the second cylinder, the cylinders being adapted to be rotated so that the first and second cylinders rotate in opposite directions with the clothing of the second cylinder travelling faster than the clothing of the first cylinder, and the working cylinder rotating in the same direction as the first cylinder with the clothing thereof travelling slower than the clothing of each of the first and second cylinders, so that in use the fibrous material travels on the clothing of the first cylinder to where the second cylinder takes the fibrous material with a drafting and tearing effect, and the working cylinder takes knotted portions, slubs and impurities from the second cylinder and carries same round and returns same to the first cylinder clothing for reprocessing.

An embodiment of the invention will now be described by way of example, with reference to the accompanying drawings, wherein.

Figure 1:
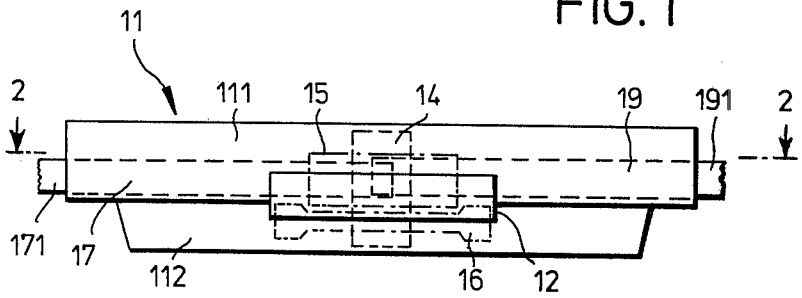
FIG. 1 is a diagrammatic side view of the feed assembly and clothing cylinders of the machine according to the embodiment of the invention.

Referring to the drawings, and firstly to FIG. 1, the machine can be considered as comprising three groups of clothed cylinders 2, 8, 12 forming one group, 8, 16 and 20 forming the second group, and 16, 24 and 26 forming the third group. It will be noticed that cylinder 8 and cylinder 16 are common to two groups. These groups of cylinders are arranged in series so that the fibrous material to be processed travels through the three groups of cylinders in sequence, the material being fed into the machine by a feed assembly A, and being ejected and removed from the machine as indicated by reference numeral 28, from the last cylinder 24.

Of each group of cylinders, there are certain common characteristics, therefore only one group of cylinders will be described in detail. Considering therefore the group comprising 2, 8 and 12, it will be seen that cylinders 2 and 8 are approximate tangential to define a transferring zone 16, and cylinder 12 is tangential to each of cylinders 2 and 8. Cylinders 2 and 8 are of identical size, whilst cylinder 12 is much smaller than each of cylinders 2 and 8. The cylinders are shown as rotating in the directions indicated by the arrows 2A, 8A and 12A respectively, and references 2B 8B and 12B show the clothing teeth formation of the respective cylinders, and the directions in which these teeth point in relation to the direction of rotation.

Considering the treatment effect on the fibrous material exercised by the first group comprising cylinders 2, 8 and 12, the fibrous material which may be loose clumps of waste material is grabbed by the forwardly projecting teeth of the clothing of cylinder 2 and is taken round by such teeth to zone 16 where cylinder 8 which is moving at a faster speed than cylinder 2, and has teeth which are correspondingly pitched to a greater extent proportanal to the speed differential, take the fibres with a combing and tearing effect, exercising a homogenising effect on the fibres. The cylinder 12 which rotates in the same direction as cylinder 2 exercises a working effect upon lumps in the fibrous material, in that the periphery of this cylinder 12 travels slower than that of cylinder 8 and cylinder 2, and the teeth are pointing backwards in relation to the direction of rotation. These teeth bar the passage of thick lumps such as knots and slubs in the fibrous material, and carry

LOCK FOR BRACELETS, BELTS AND THE LIKE

The invention relates generally to locks for bracelets, belts or the like, and more particularly to locks as required for jewelry or wrist watchbands to fasten two ends thereof together.

With respect to known bracelets of the above set forth type, one end generally is undetachably connected to the lock, whereas the other end may be fastened to the lock and detached from the lock again in any suitable manner. Also, locks are known which can be detachably fastened both at one of the ends with the end of a bracelet or chain and at its other end with the other end of the bracelet or chain, for the purpose of selectively mounting such locks to a multitude of bracelets and thus to simplify stock supply. Furthermore, bracelets are known which are provided with a lock so designed that the length of the band can be varied within certain limits, the two main parts of the lock as a rule engaging into one another a selected depth covering one another a selected amount or hooking into another in overlap. Generally this leads to lack of symmetry degrading the looks of the whole device.

The object of the invention first of all is the creation, in particular where jewelry is concerned and above all in this respect watch wristbands and also fancy belts, of locks for these devices which allow some change in length of the bracelet or belt while however preserving the symmetry between the two ends of the band and the lock in all positions.

To above stated end, with respect to a lock fastening the two ends of a bracelet, belt or the like, in which at least one end of the bracelet is detachable from the lock, the invention provides that each of the two bracelet ends is connected to a movable part of the lock, or may be connected to it, such movable parts moving synchronously but oppositely to each other and essentially along the longitudinal direction of the bracelet and being arbitrarily lockable in a selected position. A variety of elements may be provided as moving parts fo the lock, for instance sliders, control rods, levers and the like. Sliders, for instance, may be guided in length wise guides in the lock. Again these sliders may be provided with gear racks or be designed as such, associated with a gear meshing with the racks at opposite sides. In this manner every motion of the slider is transmitted through its rack to the gear and from the gear to the rack of the second slider and onto the second slider. In lieu of gear and rack, many other elements such as double-levers, cams and the like may be used for obtaining symmetry, engaging for instance slotted guides, connecting or driving rods and the like. The simplest possible means in this fashion allow a synchronous displacement of the two bracelet or band ends with respect to the lock.

The locking into position of the slider at the desired point may be carried out advantageously in simple manner by means of a disconnectable pawl or another disconnectable component, for instance, acting on one of the two gear-racks or on the gear. However, a special ratchet-wheel may be associated with the gear, if appropriate, for instance connecting the gear rigidly or through an intermediate gear and operating jointly with the pawl or other locking element. The pawl or locking element may be disconnected by a suitable element, for instance a disconnect-key appropriately mounted at one of the narrow sides of a lock housing. For reasons of reliability provision also may be made for two pawls or locking elements each one of which may then be disconnectable by a special disconnect-component, whereby the lock may only be opened if both disconnecting elements, for instance disconnect-keys, are simultaneously activated. These two disconnect-keys may be advantageously mounted at the opposite narrow faces of the lock housing.

In a further embodiment of the invention, the ratchet wheel connected to the synchronous gear may be used to control the advance-motion of the movable sliders by depressing a key or keys. One of the pawls of the ratchet-wheel in this instance then is used as both an advance and a locking pawl if no additional control elements are desired. The advance for each depression of the key(s) appropriately is selected to be equal to the tooth pitch of the ratchet-wheel, so that every depression of the key is followed by stepping of the ratchet wheel forward by one tooth. In this case, too, the lock may be opened by simultaneously depressing both keys, that is both the advance-key and the disconnect key. Furthermore one of the two keys, in particular the one which together with its associated pawl is not used to narrow the lock, may serve to open the lock step-wise until reaching a maximum latchable width of the bracelet, after which the complete opening of the bracelet is possible only through additional measures. This again can be achieved by simultaneously depressing both keys.

Another embodiment of the invention, however, allows to design one of the two sliders as including at least two parts, both parts being telescopable into one another in the direction of motion of the slider and lending themselves to being locked when so telescoped into each other. Obviously, both sliders may also be of such design. This provides additional space for the connection of the associated bracelet to the lock. Either of the two keys for the step-wise advance or stepwise opening of the lock may be used advantageously to disconnect the pawl between the two parts of a slider, provided that when the slider is in one of its end positions, the locking of the slider parts be eliminated by a disconnect element connected with or controlled by the associated key.

Many embodiments are feasible in accordance with the invention. The drawing illustrates one embodiment, where the essential parts and certain possible variations are illustrated partly in diagrammatical form for the sake of greater comprehensibility.

IN THE DRAWINGS:

FIG. 1 is a side elevational view of the lock as viewed from one of the longitudinal faces.

Figure 2:
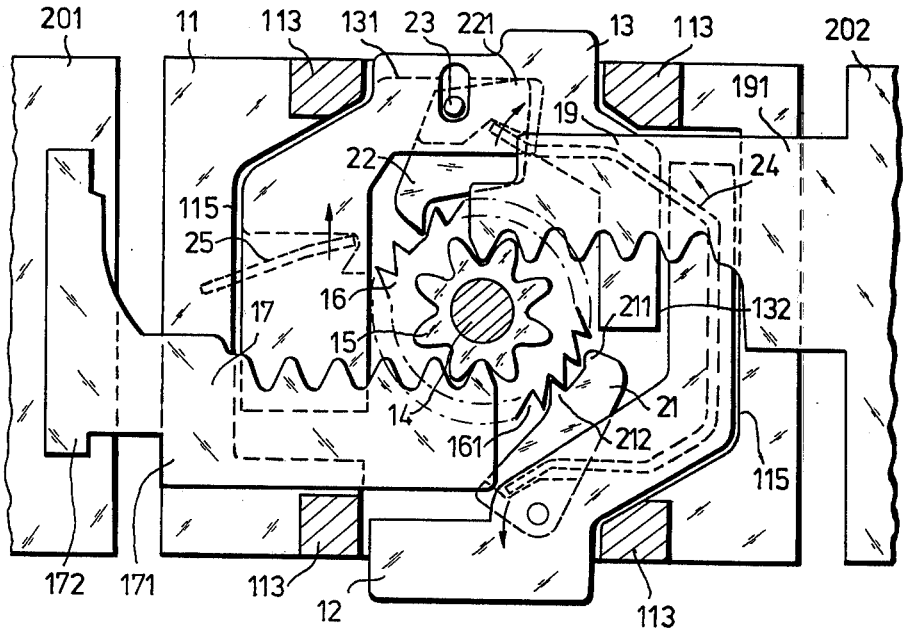
FIG. 2 is a side view of the machine of which the cylinders are shown in FIG. 1, the rear being taken from the same side.

FIG. 2 is a longitudinal horizontal sectional view taken along the line 2—2 of FIG. 1.

Figure 3:
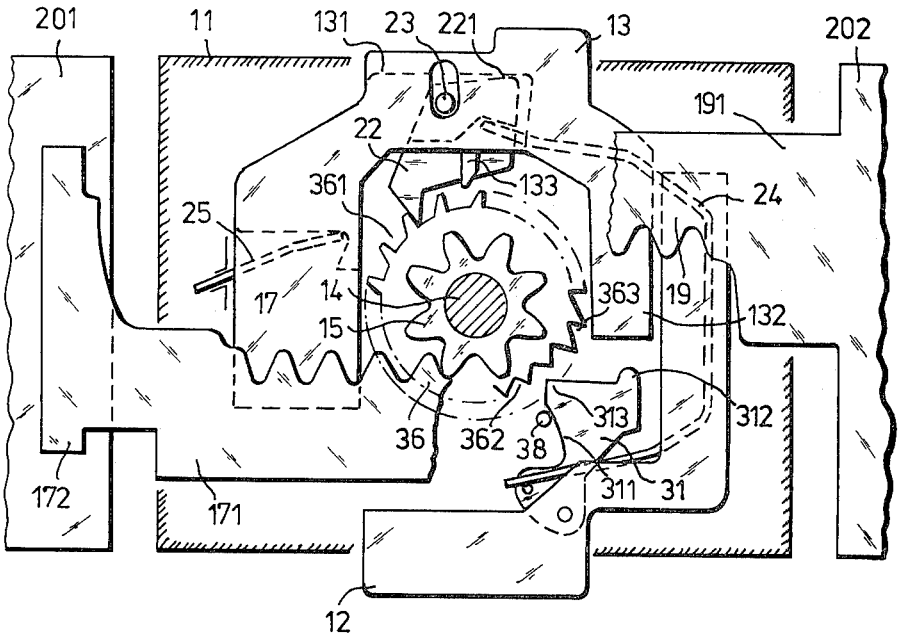
FIG. 3 is a side view; from the other side and with its drive guards removed, of the machine shown in FIG. 2.

FIG. 3 is a sectional view similar to FIG. 2 of the lock of FIG. 2 with several modified parts.

Figure 4:
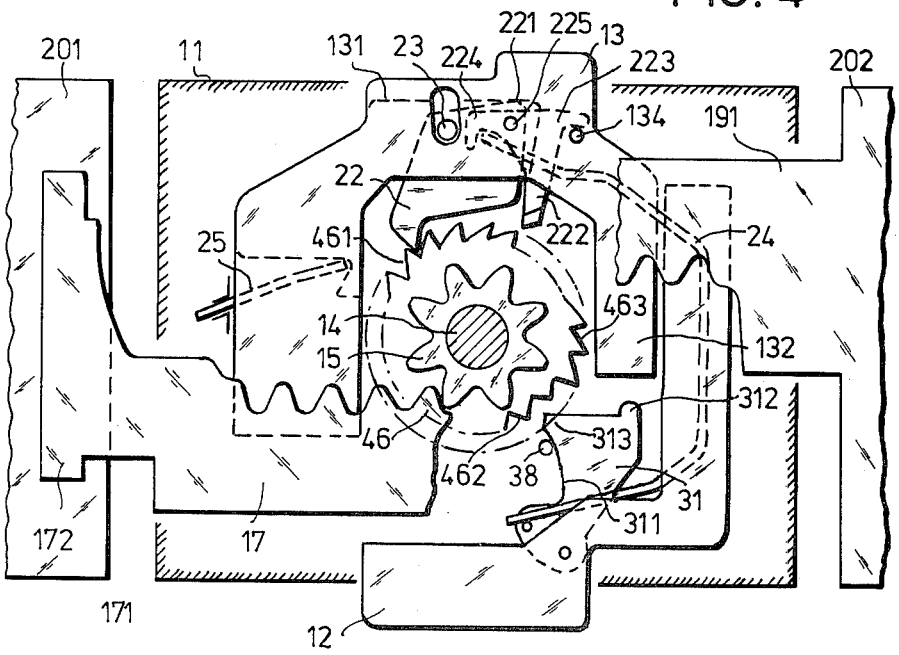

FIG. 4 is another sectional view of the lock with a further possible modification.

Figure 5:
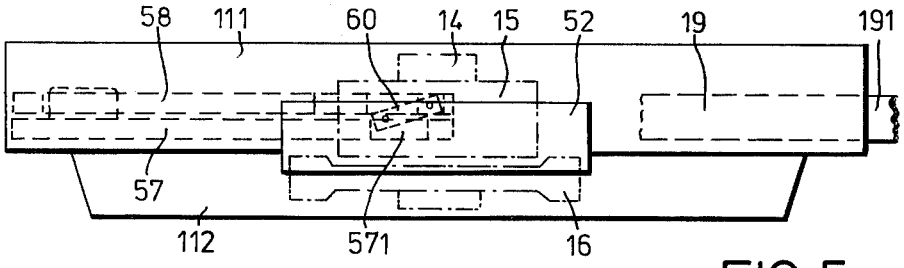

FIG. 5 is a side elevational view of another lock embodiment.

Figure 6:
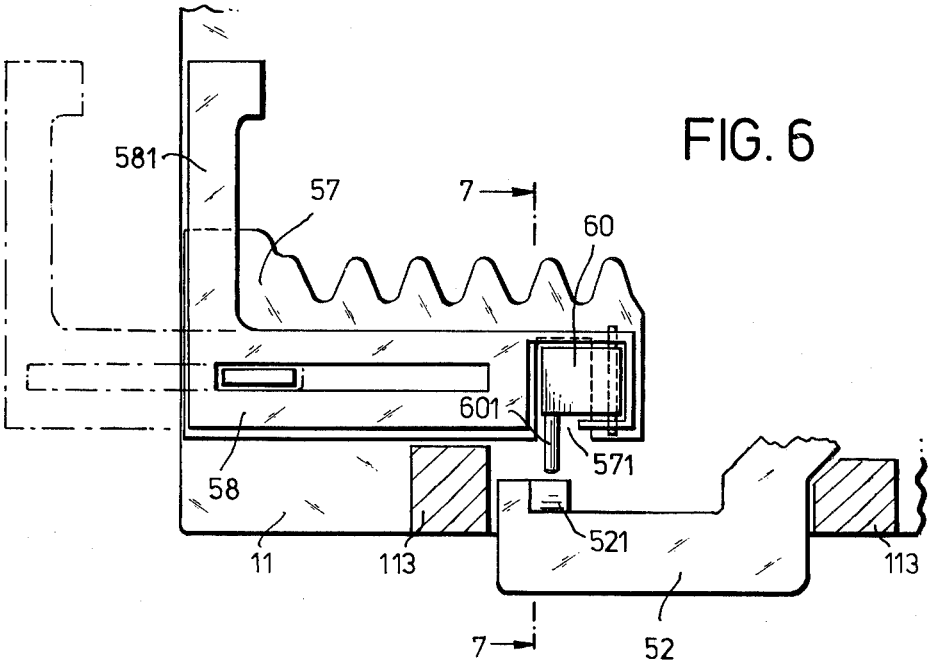

FIG. 6 is a partial plan view of certain parts of the lock of FIG. 5.

Figure 7:
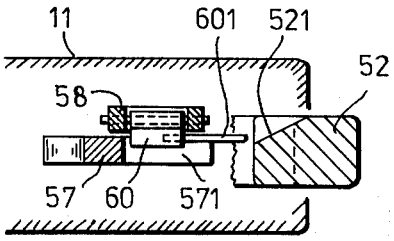

FIG. 7 is a partial transverse sectional view taken generally along line 7—7 of FIG. 6.

As regards the lock embodiment of the invention shown in FIGS. 1 and 2, two push-keys 12 and 13 are displaceably supported in a housing 11 essentially formed of two parts 111 and 112. These keys 12 and 13 are mounted at the opposite lengthwise faces of housing 11 and are located in recesses of housing parts 111 and 112. A gear 15 is rotatably supported on a shaft 14 connected with the lower part of the housing and this gear is connected itself with a ratchet-wheel 16 which is also rotatably supported on shaft 14. Gear 15 meshes with two gear-racks 17 and 19 displaceably mounted inside recesses of housing parts 111 and 112 respectively, the gear-racks meshing from opposite sides of gear 15. If gear 15 is rotated, the two gear-racks are synchronously displaced in directions opposite to each other. Gear-racks 17, 19 are designed as sliders and by means of their outward-pointing ends 171 and 191 hold ends 201 and 202, respectively, of a watch wristband, not shown in particular detail, one end 202 being solidly and rigidly connected to gear-rack end 191, while the other end 201 hooks into a hook-shaped extension 172 of gear-rack 17.

The plate-like housing parts 111 and 112 connected by spacers 113 and the keys 12 and 13 inside the housing are guided by means of guide-bars or ledges 115. If for instance, key 12 is depressed, the key moves at right angle to the lengthwise sides of the housing and rotation of the ratchet-wheel 16 on shaft 14 by one tooth 161 is effected by means of pawl 21 supported by key 12 and engaging the ratchet wheel 16. The position to which ratchet wheel 16 is moved is secured by a locking latch 22 engaging the ratchet wheel from the opposite side. Latch 22 is pivotably supported on a pin 23 carried by housing 11. Together with the stepwise rotation of ratchet wheel 16 there occurs a corresponding rotation of gear 15 in the counter-clockwise sense, so that gear-racks 17 and 19 are displaced synchronously and oppositely to each other. Thereby the ends 201 and 202 of the bracelet are made to move towards each other and the effective length of the bracelet is shortened in even measure from both ends.

A pressure is exerted on both keys 12 and 13 in the embodiment illustrated in FIGS. 1 and 2 for the purpose of loosening the bracelet. Key 13 is provided on one side with a recess 131 receiving latch 22 which has its end 221 resting against the wall of the recess. When key 13 is depressed, latch 22 disengages from ratchet wheel 16. Simultaneous pressure on key 12 disconnects also advance pawl 21, so that pawl 21, by its nose 211, is guided outward over the front face of attachment 132 and pawl tooth 212 thereby is disengaged from ratchet wheel 16. Both pawl 21 and latch 22 are pressed by a common spring 24 into their engaging position as shown in FIG. 2, the spring also simultaneously acting as a return spring for key 12. This spring rests with its two ends against the stopping edges of pawl 21 and latch 22. A spring 25 clamped by one end into the housing wall is provided as return spring for key 13 by acting on the stopping edge of key 13.

Only the components essential to the invention are shown for better comprehensibility in the modification of FIG. 3, the lock housing being indicated by a shaded contour. Depressing one of the keys insures shortening of the effective length of the bracelet and depressing the other an increase of it. Only a few modifications with respect to the embodiment shown in FIGS. 1 and 2 are required to achieve these functions. For the sake of simplicity, the same reference numerals apply to the parts of FIGS. 1 and 2 which are not modified and a new description therefore is superfluous. The ratchet wheel of the modified embodiment of FIG. 3 is essentially different, and is denoted by the numeral 36. The ratchet wheel 36 is solidly and rigidly connected with gear 15 acting on gear racks 17 and 19 and is provided with two sets of teeth 361 and 362 of different outer diameters. Locking latch 22 and a locking beak 133 additionally provided on key 13 operate jointly with the set of teeth 361. When key 13 of FIG. 3 is depressed, latch 22 is disengaged and simultaneously locking beak 133 engages the gap between two teeth of set 361. The ratchet wheel 36 then can rotate clockwise, that is in the direction of loosening, only until the next tooth from set 361 touches locking beak 133. If thereupon key 13 is released, locking latch 22 engages the adjacent tooth-gap of set 361 and the ratchet wheel following disconnection of locking beak 133 then is capable of rotating clockwise by the residual amount of one tooth elevation.

The tooth-by-tooth loosening of the bracelet is possible because an advance pawl 31, corresponding to pawl 21 of FIG. 2, was kept out of engagement with the associated tooth-set 362 for advance of ratchet wheel 36. This is obtained by combining the decrease of the diameter of the tooth-set 362 by a stop 38 limiting the pivotal excursion of pawl 31, which stop 38, in conjunction with a correspondingly profiled edge 311 of pawl 31, so controls its pivotal excursion when key is depressed that the pawl 31 engages tooth-set 362 in order to shorten the bracelet. Therefore, movement of the keys 12, 13 results in arbitrary shortening and loosening, respectively, of the bracelet.

It may be appropriate that the loosening be restricted to a given amount and that complete disconnection be made possible only by taking additional steps. To that end, a further set of teeth 363 is provided on ratchet wheel 36, with an outer diameter exceeding that of set 362. If upon depressing of key 13 the bracelet is lossened tooth by tooth, a position will finally be reached in which the clockwise stepping ratchet wheel 36 hits pawl 31 with the first tooth of tooth set 363. No further loosening by depressing key 13 then is possible. If, however, the bracelet is to be opened, both keys must be depressed simultaneously, in the manner required in the embodiment of FIGS. 1 and 2. When key 13 is depressed, the nose 312 of pawl 31 rests only against the front side of extension 132. If key 12 is depressed additionally, nose 312 glides outwardly over the front face of extension 132 and disconnects pawl-tooth 313 from the ratchet wheel 36.

Whereas loosening of the bracelet in the embodiments of FIGS. 1 through 3 takes place only when there is a sufficient pull in the longitudinal direction of the bracelet, a further embodiment illustrated in FIG. 4 provides perforce loosening by one tooth upon every pressure on the appropriate key and loosening by further teeth if a corresponding tension is exerted. To achieve this end, only a few modifications are required with respect to the embodiment of FIGS. 1 and 2, and such modifications in part overlap with those of FIG. 3. Therefore, the same reference symbols are used in FIG. 4 as in FIGS. 1 and 2 and where appropriate in FIG. 3, provided the same components are involved, and no new description is required. Use is made in the modified embodiment of FIG. 4 of a ratchet wheel 46 which largely corresponds to ratchet wheel 36 of FIG. 3. There is merely a substitution of the set of teeth 361 by a set of teeth 461. As set of teeth 463 corresponds to the set of teeth 363 and a set of teeth 462 corresponds to the set of teeth 362 of lesser diameter. Therefore, ratchet wheel 46 together with pawl 31 operate in the same manner as in the embodiment of FIG. 3. In order to achieve the desired effect of the embodiment of FIG. 4, the locking beak 133 of FIG. 3 is replaced by a pawl 222 rotatably supported at 225 near the rear end 221 of locking latch 22. Pawl 222 is provided with two extensions 223 and 224, the former resting against a stop 134 carried by key 13 and the latter, which is located on the other side of support 225, acting on spring 24. Spring 24 in this manner ensures that the pawl 22 is made to rest against stop-edge 131 with its rear end 221 and that, furthermore, extension 223 of pawl 22 is made to rest against stop 134. When key 13 is depressed, the ratchet wheel 46 is forced clockwise by one tooth and this process is repeated when the key is depressed again. However, a loosening may be exerted in the lengthwise direction of the bracelet upon depressing key 13 and so make the ratchet wheel progress clockwise only until the first tooth of the set 463 comes to rest against pawl tooth 313 of pawl 31. The bracelet then can be loosened further upon additional depression of key 12, as already described in relation to FIG. 3.

A further modification is shown in FIGS. 5 through 7. In essence, the gear-rack 17 of the embodiments of FIGS. 1 through 4 and the outward extension 171 and the hook-shaped attachement 172 is divided into two parts mutually displaceable in the bracelet's longitudinal direction. For the sake of clarity those parts which remain the same with respect to the emobidments already described keep the same reference symbols as in the prior figures. Besides the slider with gear-rack 17 and hook-like attachment 172, only key 12 is modified, and then only slightly. These steps achieve that use can be made of the full stroke of the gear-rack for shortening or lengthening the bracelet and that additional loosening can be carried out to open the bracelet. To that end a slider 58 is mounted above another slider 57. The slider 57 is provided with a gear-rack meshing with gear 15 in the manner previously described. Slider 58 is, in turn, provided with a hook-like extension 581 corresponding to extension 172 of the embodiments in FIGS. 1 through 4. Slider 57 is shown in the position of maximum bracelet loosening. However, the bracelet cannot be opened yet, its end being held by the hook-like extension 581 of supplemental slider 58 and still being located inside housing 11. Opening the bracelet requires detaching a lock connected the two slider parts 57 and 58. A latch 60 acting as locking latch locks the two parts 57 and 58 together. The latch 60 is pivotally supported by slider 58 and has a free edge forced by a spring (not shown) into a recess 571 of the slider 57 when slider 58 is in the pushed-in position. Latch 60 carries a disconnect pin 601 which will be opposite a bevelled surface on a key 52 when the lock is in the position of maximum bracelet loosening. When key 52 is depressed, bevelled surface 521 slides underneath pin 601 of latch 60 and disconnects latter. Thereupon, slider 58 may move with respect to slider 57 into the position indicated by dash-dot lines in FIG. 6 where the end of the bracelet can be detached from hook 581.

Although only preferred embodiments of the latch have been specifically illustrated and described herein, it is to be understood that minor variations may be made in the locks without departing from the spirit and scope of the invention as defined in the appended claims.

What is claimed as new:

1. Lock for connecting the two ends of a bracelet, belt and the like, which is detachably connected to at least one end of the bracelet, characterized in that each of the two ends of the bracelet is connected with a movable lock part, said lock including means mounting said lock parts for movement essentially in the lengthwise direction of the bracelet in the opposite directions, drive means for effecting synchronous movement of said lock parts, and latch means for locking said drive means in a selected position, said lock including a housing, and the movable lock parts being sliders guided inside lengthwise guides of said lock housing, said sliders including gear racks and said drive means including a gear meshed with said gear racks from opposite sides, said latch means including a disconnectable locking latch, a disconnect key for disengaging said locking latch.

2. Lock a defined in claim 1, characterized in that said lock housing is thin and has narrow sides, and said disconnect key is mounted at one of said narrow sides of the lock housing.

3. Lock as defined by claim 1, characterized in that there is at least two of said locking latches, and a disconnect-key is associated with each locking latch.

4. Lock as defined in claim 3, characterized in that said lock housing is thin and has narrow sides, and said disconnect keys acting as disconnecting elements for both locking elements are mounted at the opposite narrow sides of said lock housing.

5. Lock as defined by claim 3, characterized in that one of said locking latches of said ratchet-wheel effects the stepwise disconnection of the bracelet upon every depression of the associated disconnect-key.

6. Lock for connecting the two ends of a bracelet, belt and the like, which is detachably connected to at least one end of the bracelet, characterized in that each of the two ends of the bracelet is connected with a movable lock part, said lock including means mounting said lock parts for movement essentially in the lengthwise direction of the bracelet in the opposite directions, drive means for effecting synchronous movement of said lock parts, and latch means for locking said drive means in a selected position, said lock including a housing, and the movable lock parts being sliders guided inside lengthwise guides of said lock housing, said sliders including gear racks and said drive means including a gear meshed with said gear racks from opposite sides, said latch means including a disconnectable locking latch, said gear having associated therewith a ratchet-wheel, and said locking latch being engaged with said ratchet-wheel, said ratchet-wheel controls the motion of said sliders, and there being an advance-pawl activated by a reciprocable key carried by said housing for rotating said ratchet-wheel.

7. Lock as defined in claim 6, characterized in that there are two of said locking latches and one of the locking latches for said ratchet-wheel acts as an advance-latch.

8. Lock as defined in claim 6, characterized in that the advance of said advance-pawl per key-depression is selected to be equal to the tooth-pitch of said ratchet-wheel.

9. Lock for connecting the two ends of a bracelet, belt and the like, which is detachably connected to at least one end of the bracelet, characterized in that each of the two ends of the bracelet is connected with a movable lock part, said lock including means mounting said lock parts for movement essentially in the lengthwise direction of the bracelet in the opposite directions, drive means for effecting synchronous movement of said lock parts, and latch means for locking said drive means in a selected position, said drive means providing for a maximum wide position of the bracelet and opening of the bracelet and the like is possible only in that position.

10. Lock as defined in claim 9, characterized in that said drive means includes two control devices, and lock-opening in the maximally wide open position of the bracelet and the like requires simultaneous operation of said two control devices.

11. Lock for connecting the two ends of a bracelet, belt and the like, which is detachably connected to at least one end of the bracelet, characterized in that each of the two ends of the bracelet is connected with a movable lock part, said lock including means mounting said lock parts for movement essentially in the lengthwise direction of the bracelet in the opposite directions, drive means for effecting synchronous movement of said lock parts, and latch means for locking said drive means in a selected position, said lock including a housing, and the movable lock parts being sliders guided inside lengthwise guides of said lock housing, said sliders including gear racks and said drive means including a gear meshed with said gear racks from opposite sides, said latch means including a disconnectable locking latch, said gear having associated therewith a ratchet-wheel, and said locking latch being engaged with said ratchet-wheel, at least one of said lock parts being at least a two-part component for the purpose of connecting a bracelet and the like end to said lock, said component parts being telescoped, and lock means for locking said component parts together when in their telescoped position.

12. Lock as defined in claim 11, characterized in that there is a push key for acting on said lock means between the two telescoped component parts for disconnecting said component parts when said one lock part is in a bracelet and the like loosening position.

13. A lock for connecting two ends of an article of the bracelet and belt type, said lock comprising a thin flat lock housing having various sides and open ends, a gear rotatably mounted with said housing, sliders guided within said housing and having gear racks engaged with said gear, said sliders extending out through said housing open ends and having means thereon for attachment to the ends of said article, latch means for locking said gear against rotation, and combined latch releasing and gear drive means carried by said housing.

14. The lock of claim 13 wherein said combined latch releasing and gear drive means is in the form of a key mounted within said housing for reciprocable movement.

15. The lock of claim 14 wherein said key is mounted in one of said housing narrow sides.

* * * * *